US007080734B1

(12) United States Patent
Morris et al.

(10) Patent No.: US 7,080,734 B1
(45) Date of Patent: Jul. 25, 2006

(54) INDUSTRIAL REEL WRAP WITH SCORED FOLDING

(75) Inventors: Richard J. Morris, Prior Lake, MN (US); Mark S. Stoll, Excelsior, MN (US); Gary G. Urbanski, Eagan, MN (US)

(73) Assignee: Diversi-Plast Products, Inc., Minneapolis, MN (US)

( * ) Notice: Subject to any disclaimer, the term of this patent is extended or adjusted under 35 U.S.C. 154(b) by 0 days.

(21) Appl. No.: 10/325,682

(22) Filed: Dec. 20, 2002

Related U.S. Application Data

(63) Continuation-in-part of application No. 09/894,461, filed on Jun. 28, 2001, now abandoned.

(60) Provisional application No. 60/214,998, filed on Jun. 29, 2000.

(51) Int. Cl.
*B65D 85/66* (2006.01)

(52) U.S. Cl. ..... 206/400; 206/398; 206/410

(58) Field of Classification Search ..... 206/398, 206/400, 401, 407, 410; 53/204, 370.2, 409, 53/462; 242/579, 580, 600, 601
See application file for complete search history.

(56) References Cited

U.S. PATENT DOCUMENTS

| | | | | | |
|---|---|---|---|---|---|
| 298,562 | A | | 5/1884 | Dunnell | |
| 1,645,593 | A | * | 10/1927 | Peterson | 206/400 |
| 1,772,850 | A | | 8/1930 | Wheldon | |
| 1,989,183 | A | | 1/1935 | Blake | |
| 2,553,923 | A | * | 5/1951 | Lambert | 53/461 |
| 3,101,846 | A | | 8/1963 | Eifrid | |
| 3,120,337 | A | | 2/1964 | Thomsen | |
| 3,235,203 | A | * | 2/1966 | Antliff | 242/601 |
| 3,744,698 | A | | 7/1973 | Nederveld | |
| 3,836,094 | A | | 9/1974 | Hollingsworth | |
| 4,057,143 | A | * | 11/1977 | Kessler | 206/400 |
| 4,745,034 | A | | 5/1988 | Joly | |
| 4,858,762 | A | | 8/1989 | Kewin | |
| 5,064,066 | A | | 11/1991 | Barnes | |
| 5,366,085 | A | | 11/1994 | Kewin | |
| 5,392,585 | A | * | 2/1995 | Wall | 53/204 |
| 5,472,089 | A | | 12/1995 | Specogna et al. | |
| 5,706,945 | A | | 1/1998 | Saarinen et al. | |
| 5,873,464 | A | * | 2/1999 | Haley | 206/398 |
| 5,907,941 | A | * | 6/1999 | Fukuzumi et al. | 53/370.2 |
| 6,095,330 | A | * | 8/2000 | Essert et al. | 206/410 |
| 6,183,840 | B1 | | 2/2001 | Arrowsmith | |
| 6,619,478 | B1 | * | 9/2003 | Fukugawa et al. | 206/410 |

* cited by examiner

*Primary Examiner*—Louis Huynh
(74) *Attorney, Agent, or Firm*—Patterson, Thuente, Skaar & Christensen, P.A.

(57) ABSTRACT

An industrial reel wrap is designed for wrapping an industrial reel having a central spool and a pair of end plates connected thereto. The reel wrap includes a central portion that is spannable across a distance between the end plates of the reel. The reel wrap additionally includes first and second side portions that are coupled to the central portion. The first and second side portions each include a number of tabs along the length of the reel wrap. The tabs are securable to the exterior surface of each the end plates, the first and last of the tabs are preferably overlapped to completely enclose the industrial reel. The tabs are separated from the central portion by a double crease seam to enable easier folding of the tabs. The reel wrap may be scored to enable compact folding for shipment.

12 Claims, 7 Drawing Sheets

INDUSTRIAL REEL WRAP WITH SCORED FOLDING

RELATED APPLICATIONS

The present application is a continuation-in-part of U.S. patent application Ser. No. 09/894,461, filed Jun. 28, 2001, now abandoned, which claims priority to U.S. Provisional Application No. 60/214,998 filed Jun. 29, 2000. Each of the identified patent applications is hereby incorporated by reference in their entirety.

FIELD OF THE INVENTION

The present invention relates to the protection of materials stored on an industrial reel and, more particularly, to a corrugated wrap that is used to wrap the circumference of an industrial reel thereby providing protection to the materials stored thereon.

BACKGROUND OF THE INVENTION

Traditionally, wooden spools or industrial reels that are used to transport, store, and dispense various materials, e.g., fiber optics, other types of transmission cables, wires, etc., have had their contents protected through use of wood lagging strips, as shown in the prior art of FIG. 1.

Referring to FIG. 1, the traditional, prior art manner of preparing an industrial reel 10 for shipping through the use of wood lagging 12 is shown. Industrial reel 10 is generally fabricated from wood and includes a central spool 14 and a pair of end plates 16. Various types of wire and/or cable 18 are wrapped about the central spool 14 and maintained thereon by virtue of end plates 16 allowing industrial reel 10 to operate as a shipment, storage and dispensement container all in one. To prepare industrial reel 10 for shipment, wood lags (lagging strips) 12 are placed one-by-one around the circumference of industrial reel 10, requiring significant preparation time. Each wood lag 12 is secured at each end by a nail 19 to one of end plates 16. The nail is directed into the width 20 of each of end plates 16 rather than the interior face 22 or exterior face 23 of end plates 16. As such, a nail directed at an angle presents the possibility of extending through the interior face 22 of end plate 16, resulting in an unreliable wood lag and the possibility of damaging the contents of industrial reel 10.

Each of the lagging strips 12 has been cut to the width of the industrial reel and secured to end plates through the use of nails and a nail gun. The wood lagging 12 presents gaps between individual lagging strips through which foreign material may reach the industrial reel contents. The securing and subsequent removal of the lagging strips 12 from the industrial reel 10 adds significant time, and resultant costs, to the industrial reel shipping process. The use of nails and a powered nail gun provides the possibility of injury to the individual preparing the shipment and, as well, the possibility of injury to the spool contents through virtue of a misdirected, long-shanked nail. Additionally, the wood lagging 12 itself adds significant cost to the shipping due to the weight the lagging adds to the industrial reel and its contents. Further, the disposal and/or re-use of the wood lagging 12 is not easily facilitated and also presents a significant recycling concern. Similar problems are presented by plywood and Masonite® lagging when used in place of the wood lagging 12.

In an effort to address at least some of the problems described above, one manufacturer has produced an alternative to wood lagging 12. Specifically, the alternative is a triple-layered material, i.e., an inner layer of polypropylene foam cushioning, a middle layer of recycled polypropylene, and an outer layer of spunbonded polypropylene. The inner layer is placed in direct contact with contents of the industrial reel and is wrapped directly about the contents rather than about the circumference of the reel end plates, as shown in the prior art of FIG. 2. The material is secured against the contents of the industrial reel through use of metal banding strips, leaving the end plates exposed.

Referring to FIG. 2, the prior art alternative to the configuration of FIG. 1 is shown. In the prior art embodiment of FIG. 2, a triple-layered material 24, i.e., an inner layer of polypropylene foam cushioning, a middle layer of recycled polypropylene, and an outer layer of spunbonded polypropylene, is wrapped about the contents of industrial reel 10 and is positioned within the diameter of end plates 16. Material 24 is held in position, i.e., in direct contact with the contents of industrial reel 10, through use of one or more metal banding strips 26. As a result of this direct contact, possible damage to the contents of industrial reel 10 is increased according to the pressure applied by metal banding strips 26 upon the contents. Note that because the contents of the industrial reel is most often spooled in a manner wherein the exterior of the contents is visible as a coursed configuration, i.e., the contents is in a side-to-side/top-to-bottom layer configuration as opposed to a layer-beneath-layer configuration as in adhesive tape, many portions of the contents are exposed for potential damage from the elements or reel-to-reel contact.

The alternative described above with reference to FIG. 2 does significantly reduce the time needed to wrap and unwrap the industrial reel, it does reduce the overall weight of the industrial reel, and it does eliminate the need for nails and the possible injury they may cause. However, it introduces new problems that were not present with wood lagging. Because the material 24 of the alternative approach is in direct contact with the contents of the industrial reel 10, there is the possibility that the pattern of the material 24 will be imprinted on the contents of the industrial reel 10. Further, because this alternative approach wraps the contents of the industrial reel 10 rather than the circumference of the end plates of the industrial reel 10, there is a possibility that the exposed end plate 16 of an industrial reel 10 will roll into the contents of another industrial reel 10, thereby damaging its contents.

As such, there is a need in the art for a product that addresses the problems presented by wood, plywood, and Masonite® lagging as well as the problems presented by the above-described alternative approach.

SUMMARY OF THE INVENTION

The needs described above are in large measure met by the industrial corrugated reel wrap of the present invention. The industrial reel wrap is designed for wrapping an industrial reel having a central spool and a pair of end plates connected thereto. The industrial reel contains spooled contents that are generally wound so that a plurality of courses exists between the first and second end plates. The industrial reel wrap includes a central portion that is spannable across a distance between the end plates of the industrial reel. The industrial reel wrap additionally includes first and second side portions that are coupled to the central portion. The first and second side portions each include a number of tabs along the length of the industrial reel wrap. The tabs are securable to the exterior surface of each the end plates.

In one embodiment of the invention the industrial reel wrap is preferably provided with sufficient length so that it may continuously surround the exterior circumference of the industrial reel, spanning the distance between end plates, and so that the last tab secured to the industrial reel overlaps the first tab secured to the industrial reel to ensure a complete enclosure thereof. The tabs may be place in a side-by-side or gapped arrangement.

In another embodiment of the invention, the central portion of the industrial reel wrap is unitary with the first and second side portions of the industrial reel wrap, with the side portions being separated from the central portion by a formed double crease. The double crease is preferably used when the industrial reel wrap is of a corrugated material and the flutes of corrugation are oriented opposite to the length of the reel wrap, i.e., the flutes extend from end plate to end plate rather than about the circumference of the industrial reel.

In still another embodiment of the invention, at least the central portion is provided with one or more scores enabling the industrial reel wrap itself to be folded to a more compact shape for shipment purposes. Bi-fold or tri-fold configurations are two options for a folding scheme of the industrial reel wrap. In the instance of the industrial reel wrap being made from a double-faced corrugated material, the score line is preferably only made through one face of the double-faced corrugated material leaving the underlying corrugated and second face intact.

DETAILED DESCRIPTION OF THE PREFERRED EMBODIMENTS

An industrial, corrugated reel wrap of the present invention is shown generally at 50 in the figures and is used to protect and shield the contents of an industrial reel 10. The corrugated reel wrap 50 provides for fast installation and removal, significantly reduces the amount of weight added to the industrial reel compared to wood lagging, and reduces the possibility of injury to the shipper and/or contents of the industrial reel.

Figure 3:
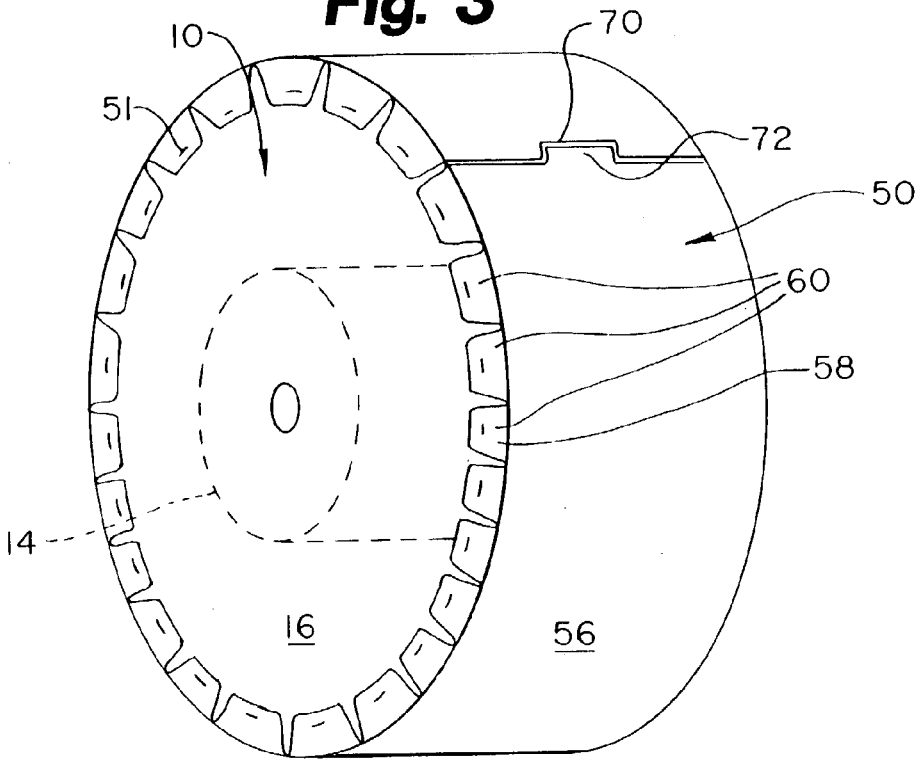
FIG. 3 depicts an industrial reel, the contents of which have been protected through the use of an industrial corrugated reel wrap of the present invention.
Figure 4:
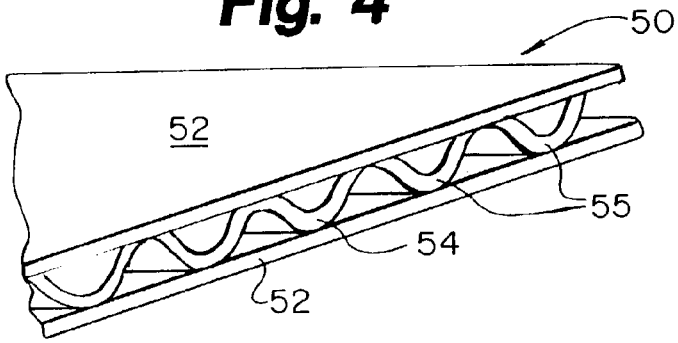
FIG. 4 depicts a corrugated material that may be used in the industrial corrugated reel wrap of the present invention.
Figure 5:
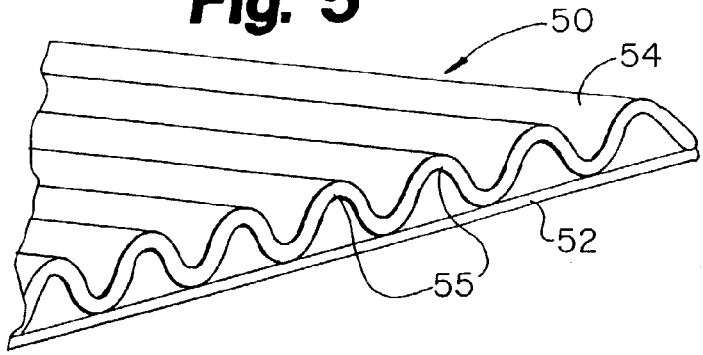
FIG. 5 depicts an alternative corrugated material that may be used in the industrial corrugated reel wrap of the present invention.
Figure 6:
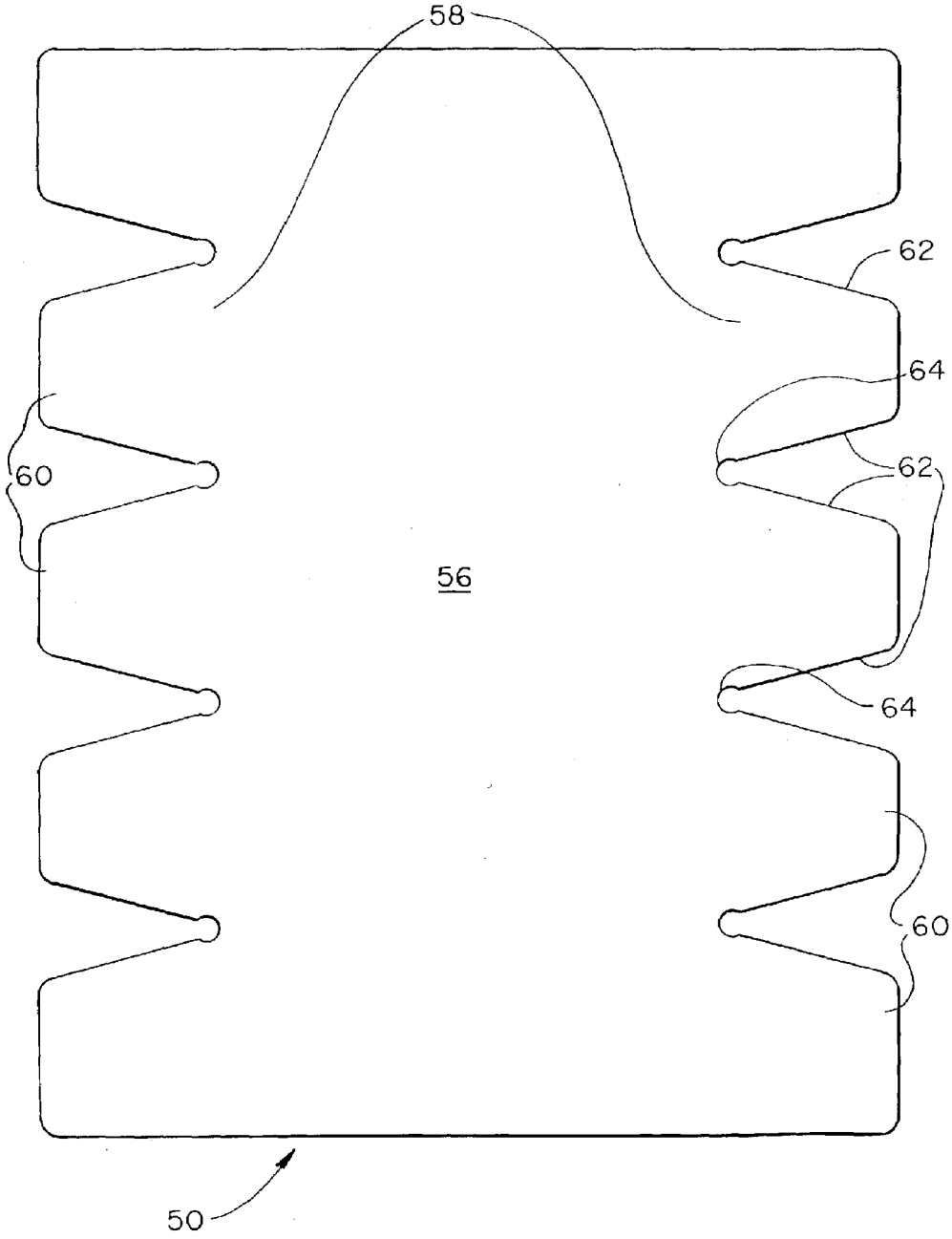
FIG. 6 depicts one pattern, having closely spaced tabs, for the industrial corrugated reel wrap of the present invention.

The industrial, corrugated reel wrap 50 of the present invention is shown in FIGS. 3–5. As FIG. 3 depicts, industrial, corrugated reel wrap 50 is designed to span the overall width of industrial reel 10 and to be secured to the exterior of industrial reel 10 by staples 51, thereby avoiding the problems associated with nailing wood lagging to the end plates. Staples 51 are selected with a length that is insufficient to penetrate the end plate 16, thereby protecting the contents of the industrial reel 10 from damage. Referring to FIGS. 3 and 6, industrial, corrugated reel wrap 50 incorporates a central portion 56, which is of sufficient width to extend between end plates 16 of industrial reel 10, and two side portions 58 that are preferably unitary with central portion 56, being joined at a respective side margin of the central portion 56. Each of side portions 58 includes a plurality of tabs 60 that have been preferably die-cut to include angled sides 62 that extend into an arc portion 64 that is common with the angled side 62 of the next proximate tab 60. Industrial, corrugated reel wrap 50 may be of any desired length and width that is suitable to a specific application.

As FIG. 4 depicts, industrial, corrugated reel wrap 50 is not a wood product but rather is a multi-layered material manufactured from high-density polyethylene (HDPE), i.e., a plastic, having a basis weight of 300 to 500 lbs. Of course, other plastics or plasticized materials, e.g., plastic coated fiberboard, may be used without departing from the spirit or scope of the invention. HDPE is used to create an industrial, corrugated reel wrap 50 that preferably incorporates two outside liners 52 and a fluted center 54, as shown in FIG. 4. Alternatively, industrial, corrugated reel wrap 50 may include only a single outside liner 52 in combination with fluted center 54, as shown in FIG. 5. The flutes 55 of fluted center 54 may extend along the length or along the width of industrial, corrugated reel wrap 50. Industrial, corrugated reel wrap 50 may be manufactured through lamination, extrusion, or other like processes.

Because industrial, corrugated reel wrap 50 is manufactured from HDPE it is 100% recyclable, thus eliminating the element of waste product that results from wood lagging. Further, because industrial, corrugated reel wrap 50 is manufactured from HDPE, it may be customized with minimal investment and can be made available in a wide range of colors, including translucents. The HDPE material also means that industrial, corrugated reel wrap 50 is unaffected by water, is stronger and more durable than corrugated fiberboard, is extremely lightweight, will not rust, rot, mildew or corrode like metal or wood, and will resist a wide range of chemicals, grease and dirt. The HDPE material allows industrial, corrugated reel wrap 50 to be easily and clearly printed upon, and to be tear, puncture, and impact-resistant for protection of the contents of industrial reel 10. The HDPE material also allows for industrial, corrugated reel wrap 50 to be made anti-static, non-conductive, ultra-violet inhibiting, flame retardant, corrosion retardant, and/or non-skid if desired. Additionally, industrial, corrugated reel wrap 50 may be made with FDA approved resins.

Figure 7:
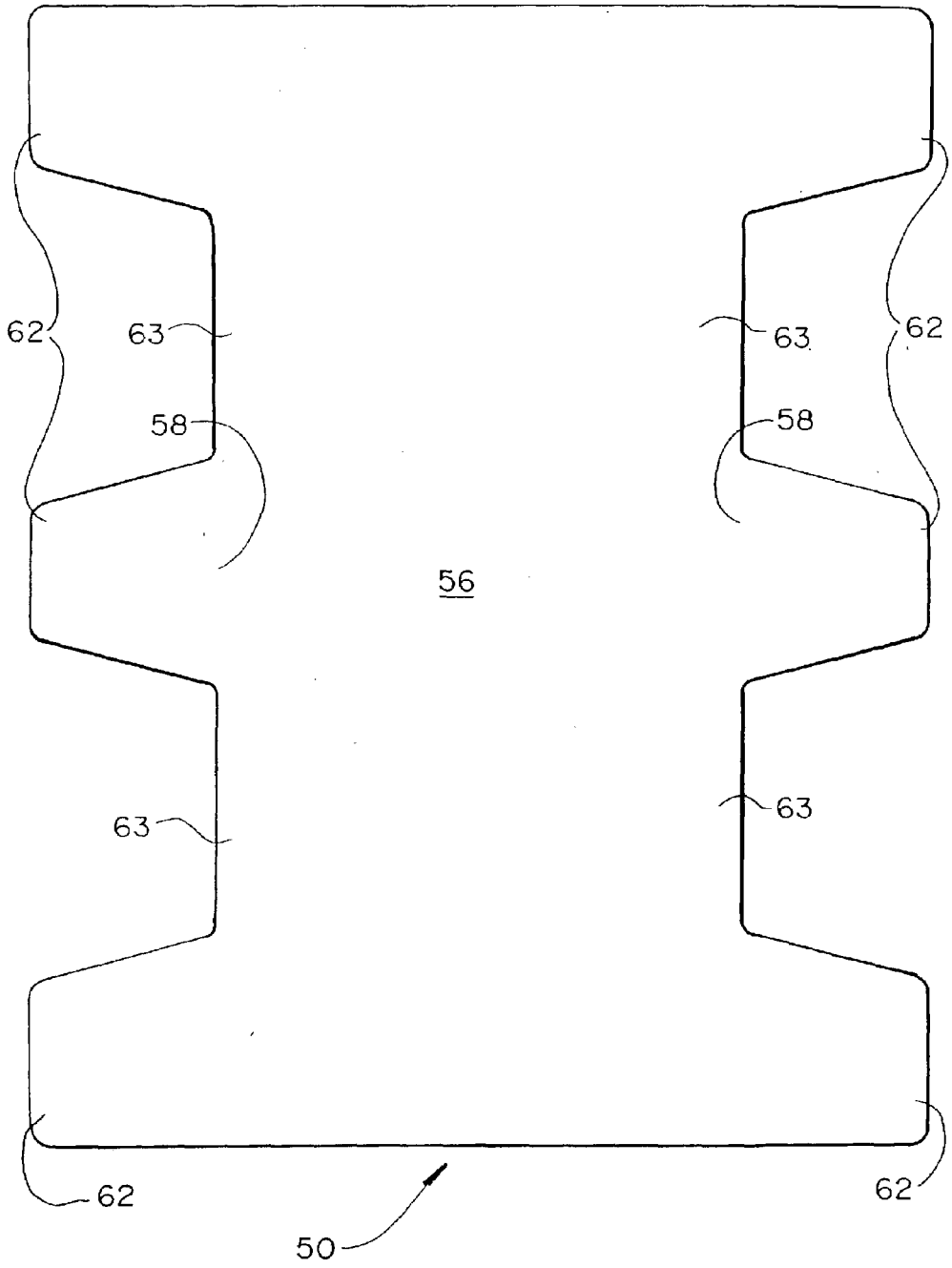
FIG. 7 depicts an alternative pattern, having set-apart tabs, for the industrial corrugated reel wrap of the present invention.
Figure 8:
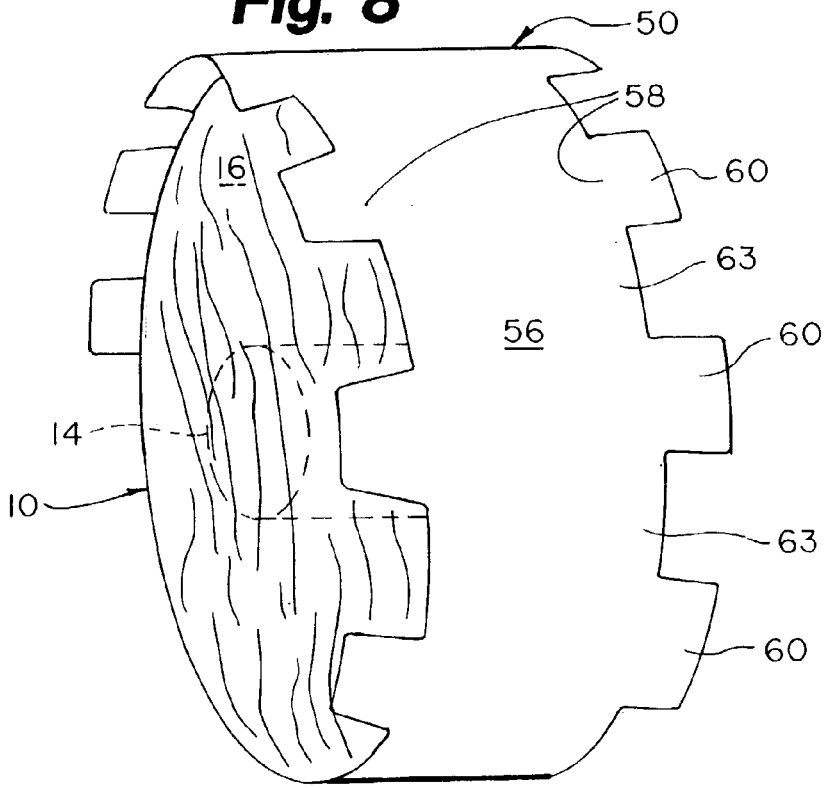
FIG. 8 depicts the industrial corrugated reel wrap, with the pattern of FIG. 7, wrapped partially about an industrial reel.

FIGS. 7 and 8 depict industrial, corrugated reel wrap 50 incorporating an alternative tab pattern to that presented in FIGS. 3 and 6; of course, numerous other patterns may be used for corrugated reel wrap 50 without departing from the spirit or scope of the invention. The alternative pattern finds industrial, corrugated reel wrap 50 having a central portion 56, which is of sufficient width to extend between end plates 16 of reel 10, and two side portions 58 that are preferably unitary with central portion 56. Each of side portions 58 includes a plurality of tabs 60 that have been preferably die-cut to include angled sides 62. However, different from the pattern described in the paragraph above, tabs 60 are separated by an elongate space 63, i.e., gapped, that is substantially equivalent in width to that of one of tabs 60.

Figure 9:
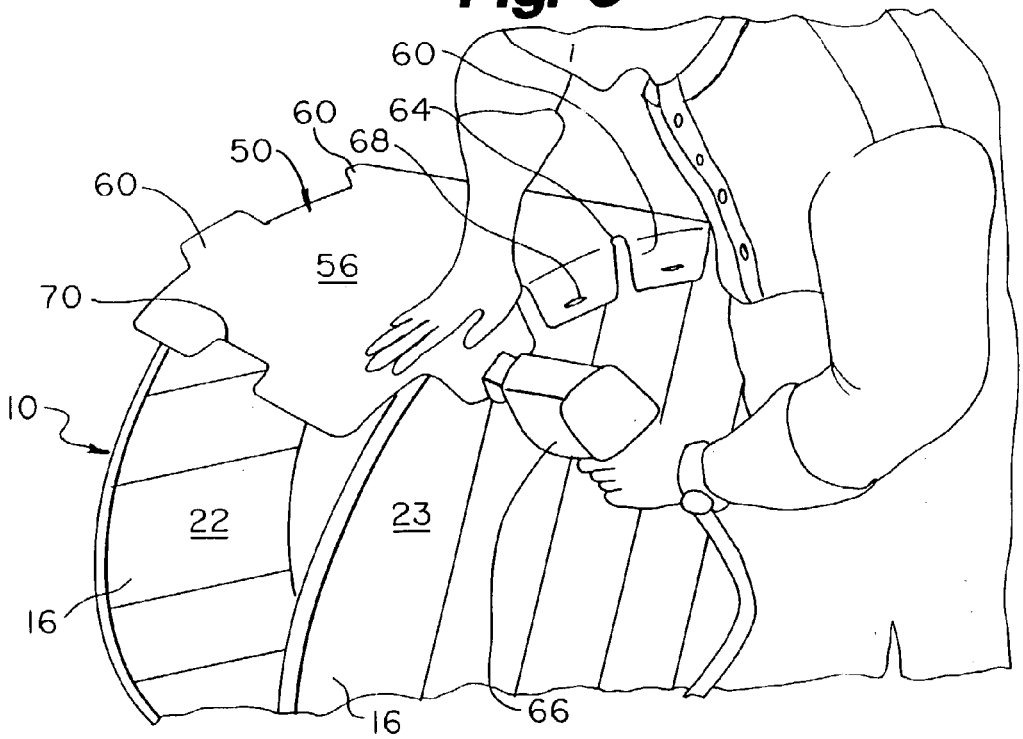
FIG. 9 depicts the industrial corrugated reel wrap of the present invention being applied to an industrial reel through use of a pneumatic fastening tool.

FIG. 9 depicts the application of industrial, corrugated reel wrap 50 to an industrial reel 10. As shown, industrial, corrugated reel wrap 50 is positioned such that central portion 56 extends between end plates 16 of reel 10, allowing tabs 60 to protrude outward. To secure tabs 60 to industrial reel 10, they are manually bent downward and fastened, preferably through use of a pneumatic fastening tool 66 (e.g., stapler, nail gun, etc.) to exterior face 23 of end plate 16, causing central portion 56 to smoothly lie along the edges of end plates 16. Arc portion 64 and spacing between tabs 60 allow each tab 60 to be bent individually without stress on proximate tabs 60 and to lie flat against end plate 16 without causing gaps between end plates 16 and central portion 56. Only one fastener 68 (including, for example, staple 51) is needed per tab 60 to secure it to industrial reel 10. Fasteners 68 are selected to have a shank length such that each of fasteners 68 does not penetrate end plate 16 and protrude through interior face 22 upon being secured to end plate 16. The process of bending and fastening is repeated for each tab 60 through the rolling of industrial reel 10 until all tabs 60 are secured and the area intermediate end plates 16 of industrial reel 10 is enclosed.

Figure 10:
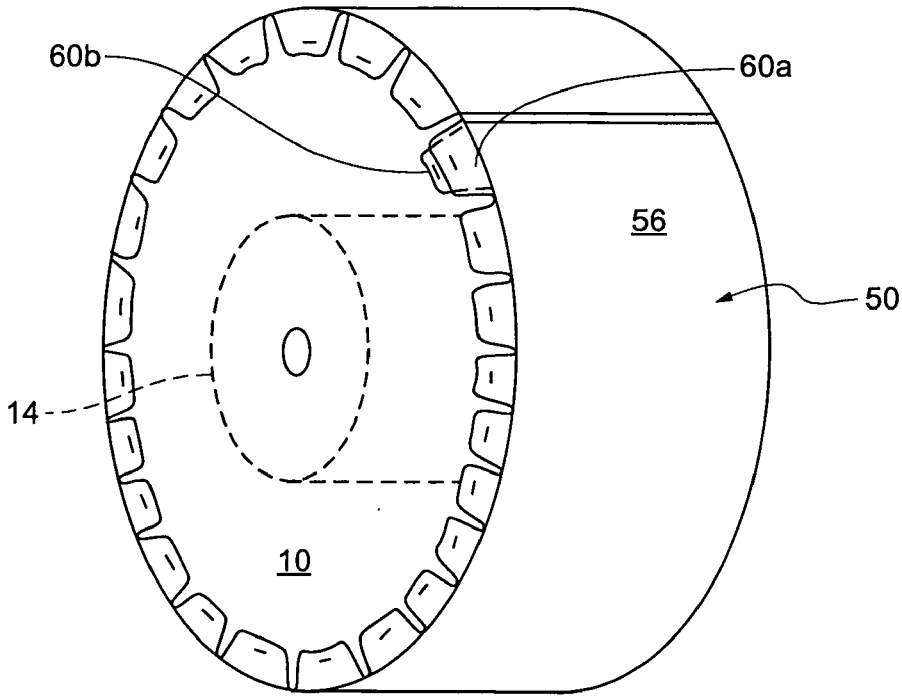
FIG. 10 depicts an industrial reel wrapped by the industrial corrugated reel wrap of the present invention wherein the end of the wrap is completed by topping the first tab with the last tab.

Completing the enclosure of the area intermediate end plates 16 may be achieved by overlapping the ends of industrial, corrugated reel wrap 50. Using this manner of completing the enclosure allows for industrial, corrugated reel wrap 50 to be dispensed and cut to a desired length for application to industrial reel 10. In a preferred embodiment of the invention, the industrial, corrugated reel wrap 50 is manufactured such that an overlap in the ends of the wrap 50 also results in an overlap of tabs 60, i.e., at least a portion of the very last tab 60*a* on industrial, corrugated reel wrap 50 is secured atop the very first tab 60*b* of industrial, corrugated reel wrap 50, see FIG. 10. The overlap of first 60*b* and last 60*a* tabs 60 helps to ensure that industrial, corrugated reel wrap 50 does not separate keeping the contents of the industrial reel 10 always enclosed. In addition to or alternatively, industrial, corrugated reel wrap 50 may be manufactured to a specific length where the ends overlap to complete the enclosure. Within these alternatives, if desired, the ends of industrial, corrugated reel wrap 50 may be provided with an interlocking notch 70 and tab 72 combination to complete the enclosure of wrap 50, as shown in FIGS. 3 and 9.

Figure 11A:
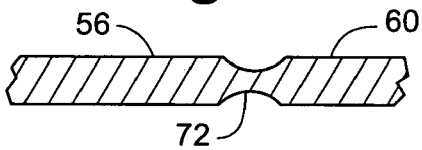
FIG. 11A depicts a single crease configuration that may be provided between the center and side portions of the industrial reel wrap.
Figure 11B:
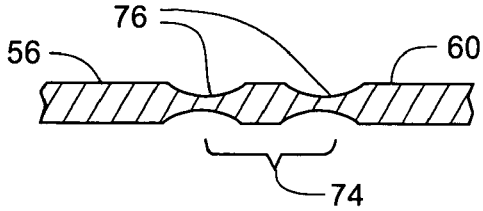
FIG. 11B depicts a double crease configuration that may be provided between the center and side portions of the industrial reel wrap.

In a preferred embodiment of industrial, corrugated reel wrap 50, side portions 58 are unitarily joined to central portion 56 via a single seam crease 72, see FIG. 11A and, even more preferably, through a double seam crease 74, see FIG. 11B. The single seam crease 72 is more appropriately used when the direction of corrugation of the flutes 55 of the industrial reel wrap 50 extend through the length of the industrial reel wrap 50; the direction of corrugation is in the same direction as the seam crease 72 making the bending or folding of the tabs 60 at the crease an easy task. The double seam crease 74 is more appropriately used when the direction of corrugation of the flutes 55 of industrial reel wrap 50 extend cross-wise to the length of the industrial reel wrap 50. In this instance, the corrugation of the flutes 55 works against the easy folding of the tabs 60 and the double seem crease 74 provides two flex points 76 at the seam enabling easier folding of the tabs 60.

By using industrial, corrugated reel wrap 50 as described above, the time spent by an individual in preparing an industrial reel for shipment is reduced by greater than ⅓ when compared to traditional wood lagging. The time for removing industrial, corrugated reel wrap 50 is also significantly reduced over the removal time of wood lagging. Further, industrial, corrugated reel wrap 50 is of a greatly reduced weight, compared to wood, plywood, or Masonite® lagging, for reduced shipping costs. Further, the possibility of injury to the shipper or to the industrial reel contents is reduced by using fasteners of reduced length and preferred placement on end plate 16. For example, staple prongs are of a significantly reduced length and width when compared to that of the shank of a nail which is used with wood lagging. Additionally, the shank of a nail used in fastening the present invention may be shorter than that used in wood lagging since the present invention is secured to exterior face 23 of end plate 16 rather than fully penetrating a piece of wood lagging and then being directed into the width of end plate 16 as is the case in wood lagging.

Figure 1:
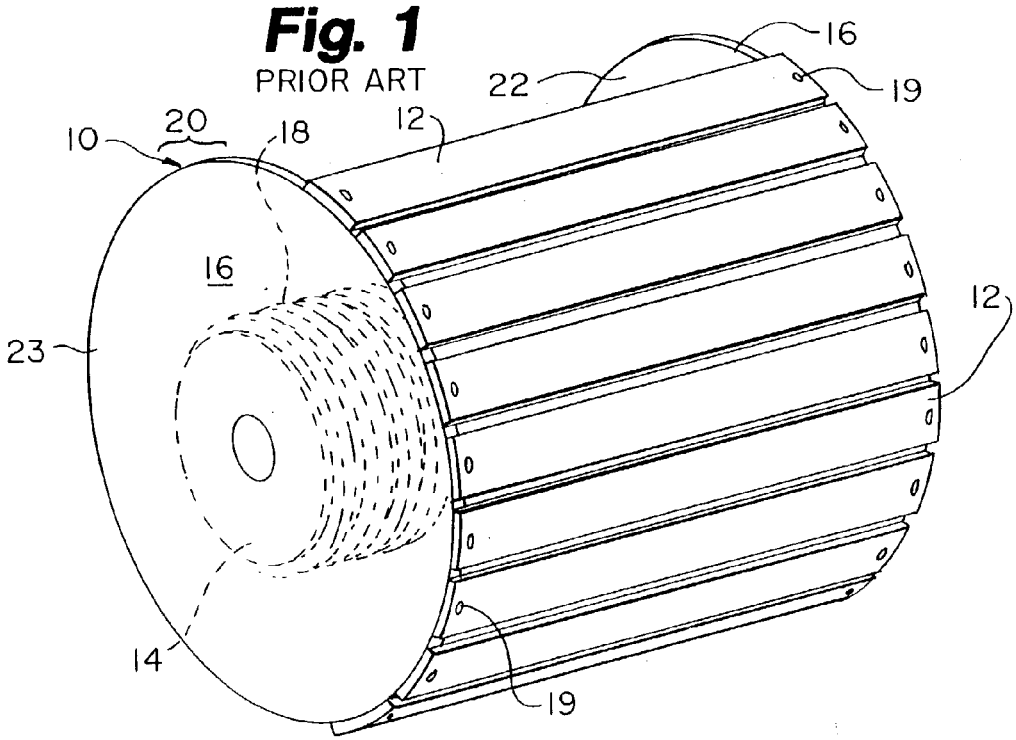
Fig. 1 PRIOR ART
FIG. 1 is a prior art configuration of an industrial reel, the contents of which have been protected through the use of wood lagging about the circumference of the industrial reel.
Figure 2:
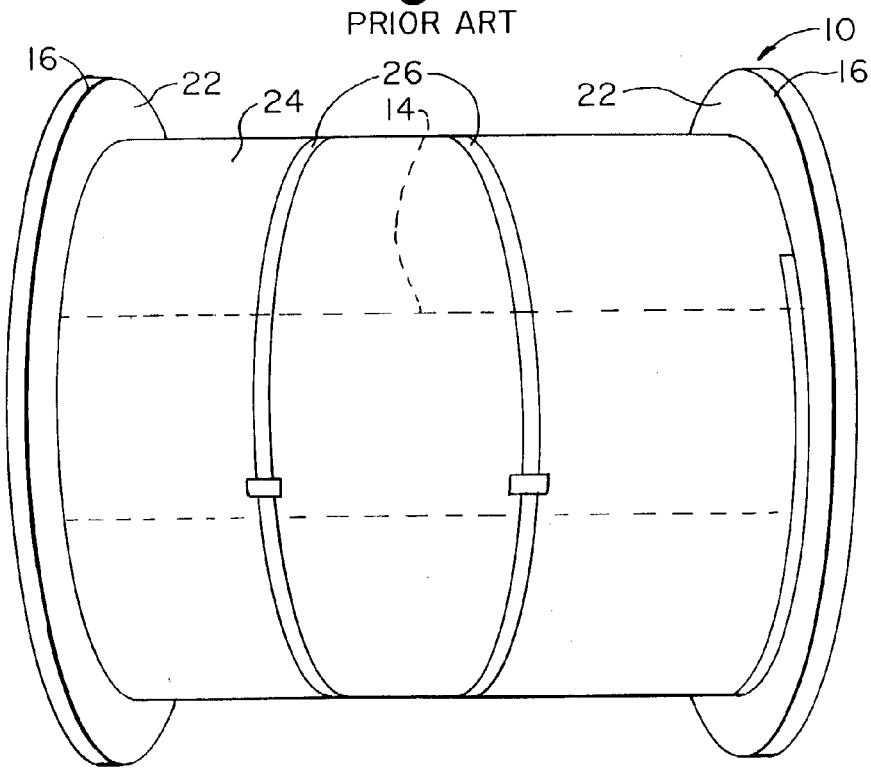
Fig. 2 PRIOR ART
FIG. 2 is a prior art configuration of an industrial reel, the contents of which have been protected through the use of a wrap that is wrapped about and in direct contact with the contents of the industrial reel.

Further, by using industrial, corrugated reel wrap 50 as described above, only the circumference of an industrial reel 10 is wrapped, i.e., there is no direct contact with the contents of the industrial reel 10 when the contents assume a circumference that is less than the circumference of the end plates 16. There is no possibility that the pattern of the industrial, corrugated reel wrap 50 is imprinted on the contents in this condition. When wrapping the circumference of the end plates 16 with industrial, corrugated reel wrap 50, a substantially rigid material, the possibility that an object may break through wrap 50 to damage the contents of the industrial reel 10 is virtually eliminated unlike the alternative prior art method shown in FIG. 2. Wrapping of the circumference with industrial, corrugated reel wrap 50 also provides a moisture barrier for the underlying contents of industrial reel 10.

Figure 12:
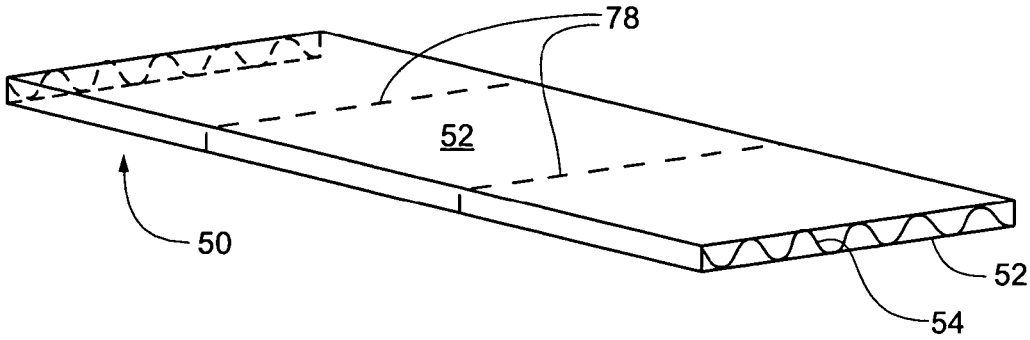
FIG. 12 depicts the industrial corrugated reel wrap having been scored to enable folding for shipping purposes.
Figure 13:
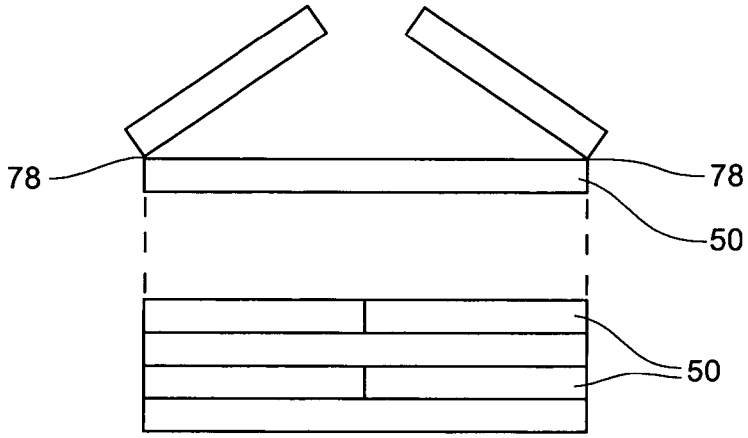
FIG. 13 depicts a plurality of industrial corrugated reel wraps that have been folded and stacked atop each other for shipping.

For shipping to customer locations wherein the industrial, corrugated reel wraps 50 will be applied to industrial reels 10, the industrial reel wrap 50 is preferably provided with one or more scores 78, FIG. 12 shows a preferred embodiment incorporating two, across the width of the industrial reel wrap 50. The scores 78 preferably only penetrate one of the outside liners 52; the scores 78 do not continue down through the fluted center 54 or the second of the outside liners 52. The scoring of the industrial reel wrap 50 enables the industrial reel wrap 50 to be folded, stacked atop each other, and atop a pallet for shipping. FIG. 13 shows a stack of tri-folded industrial reel wraps 50, each of the reel wraps 50 has two scores 78 along its width. The cutting of only one of the outside liners 52 of the industrial reel wrap 50, leaving the fluted center 54 and remaining outside liner 52 intact prevents the industrial reel wrap 50 from separating or splitting to ensure continuous and complete enclosure of the contents of the industrial reel 10.

The present invention may be embodied in other specific forms without departing from the spirit of the essential attributes thereof; therefore, the illustrated embodiments should be considered in all respects as illustrative and not restrictive, reference being made to the appended claims rather than to the foregoing description to indicate the scope of the invention.

What is claimed is:

1. A stackable, reel wrap for wrapping an industrial reel containing spooled contents, the industrial reel having a central spool separating a pair of end plates, the spooled contents spooled in a plurality of courses between a first of said pair of end plates and a second of said pair of end plates, the reel wrap having a wrap configuration and a stack configuration, the reel wrap comprising:

a central portion, said central portion of a plastic or plasticized material and being spannable across a distance between said pair of end plates so as to reside entirely exterior to a circumference of the industrial reel defined by the pair of end plates when said reel wrap is secured to said reel; and first and second side portions, wherein said first and second side portions are coupled to said central portion and include a plurality of tabs, wherein said plurality of tabs are securable to an exterior surface of said pair of end plates; and wherein said central portion includes a flat fold-enabling, shipping score, wherein said stack configuration is configured in a fold to present said reel wrap in a folded position wherein said fold occurs at said flat fold-enabling, shipping score and wherein said reel wrap is thusly presented in a substantially flat configuration wherein said substantially flat configuration of said reel wrap includes a top portion of said reel wrap unitarily joined via the fold to a bottom portion and wherein said top portion lies atop said bottom portion in a parallel presentation of top to bottom, said top portion being of substantially identical width to said bottom portion and wherein said wrap configuration presents said reel wrap in an unfolded, singular elongate configuration.

2. The reel wrap of claim 1, wherein said central portion includes a plurality of fold-enabling, shipping scores.

3. The reel wrap of claim 2, wherein said plurality of fold-enabling, shipping scores are selected from a group consisting of: a bi-fold score and a tri-fold score.

4. The reel wrap of claim 1, wherein said central portion is comprised of a double-faced corrugated material and wherein only one of the double faces of said corrugated material is scored.

5. The reel wrap of claim 1, wherein said plastic or plasticized material comprises a corrugated material.

6. The reel wrap of claim 1, wherein said central portion is continuous in length.

7. A reel wrap for wrapping an industrial reel containing spooled contents, the industrial reel having a central spool separating a pair of end plates, the spooled contents spooled in a plurality of courses between a first of said pair of end plates and a second of said pair of end plates, the reel wrap having a wrap configuration and a stack configuration, the reel wrap comprising:

plastic or plasticized spanning means for spanning a distance between said pair of end plates such that the spanning means resides entirely exterior to a circumference of the industrial reel defined by the pair of end plates when said reel wrap is secured to said reel;

first and second securing means for securing said spanning means to an exterior surface of each of said pair of end plates; and folding means within said plastic or plasticized spanning means, said folding means for enabling a substantially flat, shippable folding of said reel wrap, wherein said stack configuration of said reel wrap configures said spanning means in a fold to present said spanning means in a folded position, wherein said spanning means is presented as a top portion and a bottom portion, wherein said top portion is atop said bottom portion and is parallel thereto, and wherein said top portion is unitarily joined to said bottom portion at the fold, said top portion being of substantially identical width to said bottom portion and wherein said wrap configuration of said reel wrap presents said spanning means in an unfolded, singular elongate configuration.

8. The reel wrap of claim 7, wherein said folding means comprises a score in said plastic or plasticized spanning means.

9. The reel wrap of claim 8, wherein said folding means comprises a plurality of said scores.

10. The reel wrap of claim 7, wherein said substantially flat, shippable folding of said reel wrap is selected from a group consisting of: a bi-folding and a tri-folding.

11. The reel wrap of claim 7, wherein said plastic or plasticized spanning means is comprised of a double-faced corrugated material, and wherein only one of the double faces of said corrugated material includes said folding means.

12. The reel wrap of claim 7, wherein said spanning means is continuous in length.

* * * * *

UNITED STATES PATENT AND TRADEMARK OFFICE

CERTIFICATE OF CORRECTION

PATENT NO. : 7,080,734 B1
APPLICATION NO. : 10/325682
DATED : July 25, 2006
INVENTOR(S) : Richard J. Morris et al.

It is certified that error appears in the above-identified patent and that said Letters Patent is hereby corrected as shown below:

Title Page, Item (57) Abstract:

After "each" insert --of--.

Column 3, Line 7:

Delete "place" and insert --placed--.

Signed and Sealed this

Twenty-sixth Day of June, 2007

JON W. DUDAS
*Director of the United States Patent and Trademark Office*